United States Patent [19]

Diamond

[11] Patent Number: 4,562,964

[45] Date of Patent: Jan. 7, 1986

[54] COVER PLATE FOR FLUID NOZZLES AND THE LIKE

[76] Inventor: Harvey E. Diamond, 12953 Woodbridge St., Studio City, Calif. 91604

[21] Appl. No.: 709,540

[22] Filed: Mar. 8, 1985

Related U.S. Application Data

[63] Continuation of Ser. No. 572,689, Mar. 8, 1984, abandoned, which is a continuation of Ser. No. 314,229, Oct. 23, 1981, abandoned.

[51] Int. Cl.[4] ..... B05B 15/00

[52] U.S. Cl. ..... 239/288.5; 126/317; 174/66; 239/600; 285/46; D8/351

[58] Field of Search ..... 239/288–288.5, 239/587, 600; 128/66; D24/38; D8/350–352; 137/359, 371; 292/357; 174/66; 126/317; 285/46; 220/241

[56] References Cited

U.S. PATENT DOCUMENTS

| | | | |
|---|---|---|---|
| 2,778,665 | 1/1957 | Young et al. | 292/357 X |
| 2,827,914 | 3/1958 | Alters | 137/371 X |
| 3,540,438 | 11/1970 | Jacuzzi | 128/66 |
| 3,799,453 | 3/1974 | Hart | 239/600 |
| 4,221,336 | 9/1980 | Diamond | 239/600 X |
| 4,327,841 | 5/1982 | Wimberly | 174/66 X |
| 4,407,023 | 10/1983 | Norton | 285/46 X |

*Primary Examiner*—Andres Kashnikow

*Attorney, Agent, or Firm*—I. Morley Drucker; Howard N. Sommers

[57] ABSTRACT

A readily snap-fitted and removable cover plate, for covering the outwardly-facing or exposed surface of a fluid nozzle body flange, includes a body portion for covering such flange, and tabs projecting from segments of the body portion, movable into and out of alignment with portions of the flange defining an opening therethrough, so as to be retained in or released from engagement with the flange. Spring loading biases the cover plate projecting tabs against the flange to retain engagement of the cover plate with the flange. The cover plate exposed surface has a finish different from the finish of the exposed surface of the flange, which cover plate finish may be selected so as to coordinate with the finish of other fittings in the bathroom.

6 Claims, 6 Drawing Figures

COVER PLATE FOR FLUID NOZZLES AND THE LIKE

This application is a continuation, of application Ser. No. 572,689, filed 3/8/84 which is a continuation of application Ser. No. 314,229, filed 10/23/81, both now abandoned.

BACKGROUND OF THE INVENTION

The invention relates generally to base members or substrate members having a central opening such as fluid nozzles, and, in particular, to a readily snap-fitted and readily disengageable cover plate for a fluid nozzle. The cover plate of this invention has application to, and is particularly adapted for, covering the exposed surface of a fluid nozzle body which includes a nozzle outlet rotatable to a variety of positions within a nozzle housing, to direct a jet of water, or water and air, in a given direction. The invention has particular application to nozzle designs such as shown in my prior art patent, U.S. Pat. No. 4,221,336 incorporated herein by this reference, as well as to other nozzle designs such as that shown in U.S. Pat. No. 3,997,116.

BRIEF DESCRIPTION OF THE PRIOR ART

The applicant is not aware of other cover plates of the type herein which can be readily and efficiently snap-fitted into, and/or readily retracted from, engagement with a fluid nozzle body outer flange, or base members, in general.

SUMMARY OF THE INVENTION

The present invention is directed towards a readily engageable and removable cover plate for a base member having an exposed surface and a central opening, and is particularly adapted for covering the outwardly-facing or exposed surface of a fluid nozzle body flange for the purpose of coordinating the finish of the exposed nozzle surface with the surrounding decor and/or fittings.

Specifically, the invention disclosed herein is particularly directed towards a cover plate, including a body portion, and tab portions projecting from the body portion for engaging a nozzle body flange upon snap-fit positioning thereof. The body portion is generally ring-shaped, has a central opening, including an inner cylindrical, rearwardly outstruck rim extendable into a central opening in the nozzle body flange, and a peripheral outer circular rim, extendable about a peripheral outer edge of the flange. The flange central opening further includes passages communicating therewith which, with the central opening, define a flange keyway. The tab portions comprise one or more tab members, projecting rearwardly from the body portion inner rim, insertable through the keyway.

Snap-fitting of the cover plate is initiated by aligning the projecting tab portions with the flange keyway passages, and inserting the inner rim and projecting tabs through the flange keyway.

Upon such aligned insertion, the cover plate is freely movable relative to the flange by rotation thereof, and the tab portions are moved from their initial position of alignment with the keyway passages to a position of abutment with an inner wall surface or inner shoulder of the flange. It is preferred that the cover plate be stably retained against the flange wall and for this purpose, the tabs are engageable with the inwardly facing shoulder or inner wall of the nozzle body flange upon rotation of the cover plate body portion.

A spring loading for biasing the tabs against the inner flange wall is provided by a spring means, which forces the tab member(s) against the flange wall and thereby stably positions the cover plate. The spring means may bear directly on the tab members but, preferably, bears on a nozzle body, forcing the nozzle body outwardly against an annular low-friction bushing member, the bushing member, in turn, bearing against the inner flange wall. In this case, the tab members of the cover plate bear directly against the bushing member. The tabs are retained in the engaged position, non-aligned with the keyway passages, by spring loading through the spring means.

The cover plate of the present invention is readily, efficiently, and securely snap-fitted into, and removed from, engagement with a fluid nozzle body flange, and provides a different coordinated finish for the nozzle. The cover plate mounting means is particularly used in combination with fluid nozzles, for ejecting water, or water and air admixture, in which the fluid nozzle is provided with a spring-loaded, rotatable and adjustable ball outlet means. The invention has other advantages which will become apparent from the detailed description and drawings contained herein.

BRIEF DESCRIPTION OF THE DRAWINGS

FIG. 3 is a perspective partly-broken view of the cover plate of this invention, mounted onto a fluid nozzle body, the nozzle body being in turn installed on a wall of a whirlpool bath or the like;

DETAILED DESCRIPTION OF THE PREFERRED EMBODIMENT

Figure 1:
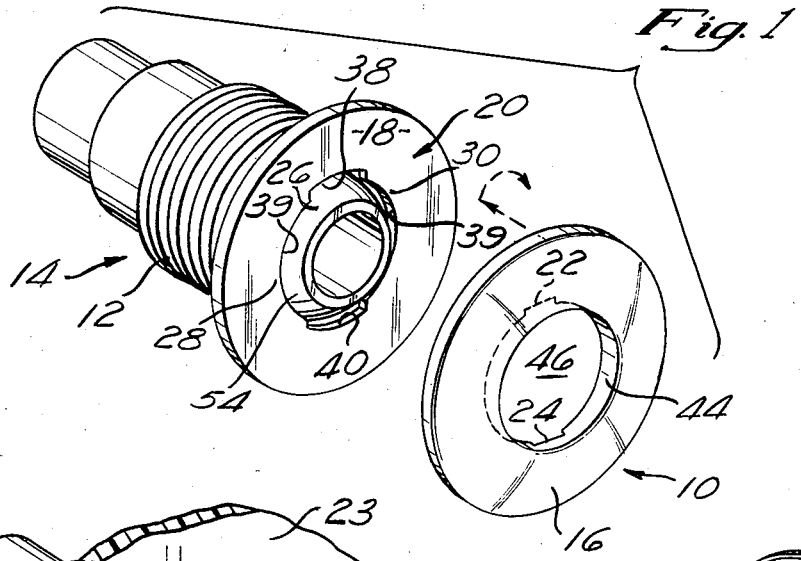
FIG. 1 is a perspective partly-exploded view of a cover plate of this invention aligned for mounting onto a fluid nozzle body, in a preferred embodiment.
Figure 3:
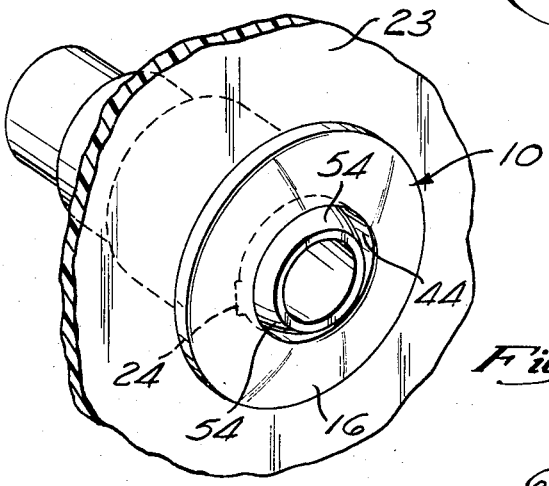

Referring to FIG. 1, the cover plate 10 of the present invention is shown in an aligned position for mounting to a nozzle body 12 of a fluid nozzle 14 for fitting therewith. A preferred type of fluid nozzle 14 is described in U.S. Pat. No. 4,221,336 entitled "NOZZLE WITH DIRECTIONALLY VARIABLE OUTLET". As particularly shown in FIG. 5, such fluid nozzles 14 are preferably formed with unitary nozzle body 12 having a cavity 21 in its normally frontal portion (see FIG. 5). A rotatable ball or nozzle outlet 54 is insertable through the front entrance of the cavity 21 and is spring loaded by means of spring 60 urging the ball outlet 54 towards and against an inner wall or inner shoulder 50 (see FIG. 6) of a flange member 20 integrally formed at the front end of the nozzle body 12. In the usual installation nozzle body 12 is inserted through a bathtub wall 23 (shown in FIG. 3) until the flange member 20 abuts the interior surface of the bathtub wall 23 and the nozzle body 12 is stably retained or mounted to the wall 23 by an internally threaded nut member of conventional nature. The flange member 20 has an exposed surface 18.

Generally speaking, the cover plate 10 includes an annular or ring-shaped body portion 16, for covering the exposed surface 18 of flange 20 of the nozzle body 12. Tab portions 22 and 24 project rearwardly from the body portion 16, and are insertable through a central keyway 26 in flange 20. The inserted tab portions 22 and 24 are further movable, by rotation, into positions engaged with and retained by flange wall portions 28 and 30 defining both a central opening 39 within said flange 20 and keyway passages 38, 40. Keyway passages 38, 40, together with central opening 39 of the flange 20 are collectively referred to as the keyway 26 of the nozzle body 12.

Figure 2:
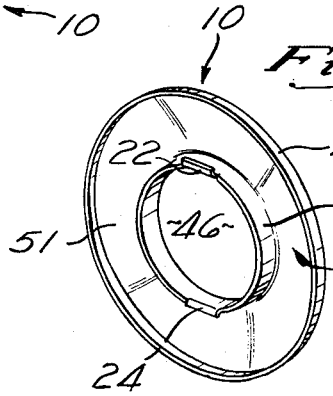
FIG. 2 is a rear perspective view of the cover plate of FIG. 1.
Figure 4:
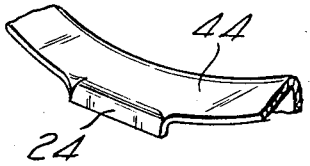
FIG. 4 is an enlarged, fragmentary view of a portion of the cover plate of FIG. 2.

Referring now to FIGS. 2 and 4 as well as to FIG. 1, body portion 16 is preferably formed of thin, strong material such as metal, e.g. stainless steel or brass, or plastic and which includes a finish on the outwardly-facing surface 42 coordinated with popular fitting finishes, such as brass, stainless steel, or the like. Body portion 16 further includes an inner rearwardly extending cylindrical rim 44, defining a central opening 46, an outer peripheral circular rim 48, and an inwardly-facing, non-exposed, surface 51. The shape of body portion 16 is preferably generally slightly convex and generally complementary to the shape of nozzle body flange 20.

Figure 5:
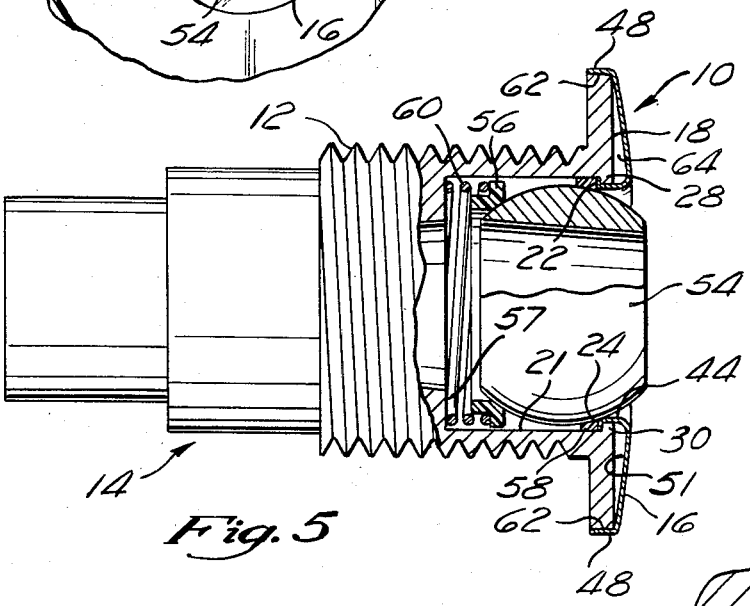
FIG. 5 is a side elevational, partly-sectional partly-broken view of the combination cover plate and fluid nozzle body of FIG. 3.
Figure 6:
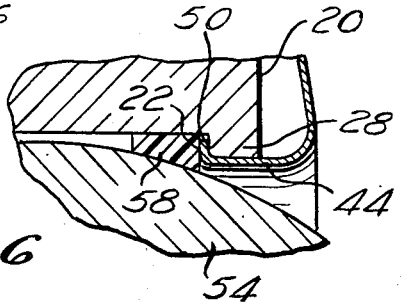
FIG. 6 is an enlarged, fragmentary sectional view of a portion of the combination cover plate and fluid nozzle body within the arrow 6—6 of FIG. 5.

Rearwardly projecting portions 22 and 24 comprise integral tabs projecting, and outstruck from, body portion inner rim 44. Each tab 22 and 24 is preferably generally complementary in shape to keyway passages 38 and 40 of the keyway. Referring to FIGS. 5 and 6, the keyway (38, 39, 40) of nozzle body 12 opens directly into nozzle cavity 21. Fluid nozzle 14 further includes a generally spherical (or spherically segmented) adjustable nozzle or ball outlet 54, ring-shaped inner and outer bearing members 56 and 58, externally dimensioned so as to be insertable through the keyway, and a coiled spring 60, the inner end of which bears against the inner end 57 of cavity 21, the other end of which bears against inner bearing member 56. Flange 20 includes an outer edge 62.

Engagement of the cover plate, with the fluid nozzle body, as shown in FIGS. 1, 3, 5 and 6, will now be described. The cover plate 10 is aligned with fluid nozzle 14, as shown in FIG. 1, with the tabs 22 and 24 of cover plate 16 aligned with the flange keyway passages 38 and 40. Cover plate 12 is then press-fitted, such that tabs 22 and 24 are inserted through flange keyway passages 38 and 40, so as to bear against nozzle outlet 54. Inner rim 44 thus projects through the flange keyway opening 32 and the outer rim 48 of cover plate 16 extends about flange outer edge 62, and such that space 64 is formed between the initially exposed flange outwardly-facing surface 18 and body portion inwardly-facing surface 50. Tabs 22 and 24 are then rotated by rotating body portion 16 against pressure exerted by spring 60 through bearings 56 and 58 and nozzle outlet 54, such that such tabs 22 and 24 are caused to assume a non-aligned position with flange keyway passages 38 and 40, and are aligned with inner flange walls 28, 30 defining the keyway passages 38, 40 in which position cover plate 12 is stably secured to nozzle body 12.

Pressure is exerted against tabs 22 and 24 by bearing 58, and through nozzle outlet 54 and bearing 56, by spring 60, to securely urge tabs 22 and 24 into engaging relation with the inner walls 28, 30 of flange 20. In such position, the body portion 16 faces outwardly and covers the outwardly-facing surface of flange 20, so as to provide a different finish, and portions of body portion 16 cover flange keyway passages 38 and 40 preventing dislodging of the nozzle outlet 54.

The engagement procedure described above is reversed for disengagement. During disengagement, it is to be noted that once the tab members 22, 24 are rotated into alignment with the keyway passages 38, 40, the cover plate 10, will under spring pressure, be immediately ejected from the flange 20 of the nozzle body 12. In this way, an untrained or unskilled person can readily engage and disengage the cover plate of this invention without the need for special tools or tradesmen.

In an alternate embodiment of the present invention, not shown in the drawings, the cover plate 16 is shaped complementary to flange 20 such that cover plate 16 is slidably movable and rotatable along flange 20, with cover plate 16 inwardly-facing surface 50 abutting flange outwardly-facing surface 18. As in the preferred embodiment described above, cover plate 10 is engageable with nozzle body flange 20 by aligning, inserting, moving and rotating into non-alignment, and biasing tabs 22 and 24 relative to keyway passages 38 and 40.

While the projecting portions and key passages have been shown as a pair of elements complementary to passages 38 and 40, the invention includes a unitary non-complementary interfittable projecting element insertable through a passage, as 38.

The present invention is of efficient and convenient design, enabling rapid interconnection and disconnection for changing the face finish of a fluid nozzle, and for preventing removal of a nozzle outlet. These and other advantages will be appreciated by those skilled in the art from the present specification.

While, in the above description, preferred and alternate embodiments of the invention have been set forth for purpose of explanation, it will be understood that variations and changes may be made therein without departing from the scope and spirit of the invention.

I claim:

1. A plate for covering the outwardly-facing face portion of a flange at an outer end of a fluid nozzle body adapted to be mounted in a bathtub wall, which flange face portion has a finish thereon, and for enabling a change, to a different finish, of the finish of the flange face portion, which flange further includes portions defining an opening therein, and an inner surface thereof, which cover plate is adapted to be movable into and out of alignment with the opening-defining portions of the flange, and to be freely rotable into and out of engagement with, and positions relative to, the inner surface of the flange, so as to be retained in or released from engagement with, and freely rotatable into and out of positions relative to, the flange, comprising:

(a) a body portion, adapted to interfit in the opening in the flange and cover the face portion of the flange, including an outwardly-facing portion having a shape generally complementary to the shape of the face portion of the flange, the finish of which outwardly-facing portion of the plate is different from the finish of the face portion of the flange, and portions defining an opening having a shape generally complementary to the shape of the opening in the flange, the body portion being adapted to be movable, and freely rotatable, into and out of positions relative to the flange; and (b) a retainer portion, which projects from the rearmost part of the opening-defining portions of the body portion, in a plane generally transverse to the axis of such opening-defining portions of the body portion, the retainer portion having a shape generally complementary to the shape of the opening-defining portions of the flange, which retainer portion is adapted to be movable into and out of alignment with the opening-defining portions of the flange, and to be freely rotatable into and out of positions of abutment with the inner surface of the flange, so as to be retained in or released from engagement with, and to be freely rotatable in relation to, the inner surface of the flange.

2. A cover plate as in claim 1, in which part of the opening-defining portions of the flange defines a keyway passage which communicates with other parts of the opening-defining portions of the flange, and in which the retainer portion of the cover plate has a shape generally complementary to the shape of the keyway passage part of the flange.

3. A cover plate as in claim 1, in which the opening-defining portion of the body portion comprises a generally tubular shaped portion including a rim at the rearmost part thereof, and the retainer portion comprises a tab outstruck from the rim of the body portion.

4. A cover plate as in claim 2, in which the keyway passage part of the opening-defining portions of the flange defines a plurality of keyway passages, each of which communicates with other parts of the opening in the flange, and in which the retainer portion of the cover plate comprises a plurality of retainer portions, each of which has a shape generally complementary to the shape of each of the plurality of keyway passages in the flange.

5. A cover plate as in claim 3, in which the retainer portion comprises a plurality of tabs, each outstruck from the rim of the body portion.

6. An apparatus for enabling a change, to a different finish, of the finish of the outwardly-facing portion of a fluid nozzle body adapted to be mounted in the wall of a bathtub, comprising:

(a) a flange, at the outer end of the fluid nozzle body, including a face portion facing outwardly therefrom which includes a finish thereon, and further including portions defining an opening therethrough, and an engagable inner surface thereof; and (b) a plate, for covering the face portion of the flange, adapted to be movable into and out of alignment with the opening-defining portions of the flange, and to be freely rotatable, into and out of engagement with, and positions relative to, the inner surface of the flange, so as to be retained in or release from engagement with, and to be freely rotatable in relation to, the flange, which plate includes an outwardly-facing portion thereof, of a finish different from the finish of the face portion of the flange.

* * * * *